US008965775B2

(12) United States Patent
Virette et al.

(10) Patent No.: US 8,965,775 B2
(45) Date of Patent: Feb. 24, 2015

(54) ALLOCATION OF BITS IN AN ENHANCEMENT CODING/DECODING FOR IMPROVING A HIERARCHICAL CODING/DECODING OF DIGITAL AUDIO SIGNALS

(75) Inventors: David Virette, Munich (DE); Pierre Berthet, Noyal-Chatillon-sur-Seiche (FR)

(73) Assignee: Orange, Paris (FR)

( * ) Notice: Subject to any disclaimer, the term of this patent is extended or adjusted under 35 U.S.C. 154(b) by 200 days.

(21) Appl. No.: 13/382,794

(22) PCT Filed: Jun. 25, 2010

(86) PCT No.: PCT/FR2010/051308

§ 371 (c)(1),
(2), (4) Date: Mar. 23, 2012

(87) PCT Pub. No.: WO2011/004098

PCT Pub. Date: Jan. 13, 2011

(65) Prior Publication Data

US 2012/0185256 A1 Jul. 19, 2012

(30) Foreign Application Priority Data

Jul. 7, 2009 (FR) ..... 09 54688

(51) Int. Cl.
*G10L 19/00* (2013.01)
*G10L 19/24* (2013.01)
(Continued)

(52) U.S. Cl.
CPC ..... *G10L 19/24* (2013.01); *G10L 19/002* (2013.01); *G10L 19/0212* (2013.01); *G10L 19/038* (2013.01)
USPC ..... 704/500; 704/229

(58) Field of Classification Search
CPC ..... G10L 19/008; G10L 19/24; G10L 19/167; G10L 21/038; G11B 20/10527; H04B 1/665; H04B 1/667
USPC ..... 704/500, 229
See application file for complete search history.

(56) References Cited

U.S. PATENT DOCUMENTS

2005/0015246 A1* 1/2005 Thumpudi et al. ..... 704/229
2006/0036435 A1* 2/2006 Kovesi et al. ..... 704/229
(Continued)

OTHER PUBLICATIONS

Tammi et al., Scalable Superwideband Extension for Wideband Coding, IEEE International Conference on Acoustics Speech and Signal Processing (ICASSP) 2009, Apr. 19-24, 2009, Taipei, Taiwan, p. 162-164.*

(Continued)

*Primary Examiner* — Vincent P Harper
(74) *Attorney, Agent, or Firm* — David D. Brush; Westman, Champlin & Koehler, P.A.

(57) ABSTRACT

A method of binary allocation in an enhancement coding/decoding for improving a hierarchical coding/decoding of digital audio signals, including a core coding/decoding in a first frequency band and a band extension coding/decoding in a second frequency band. For a predetermined number of bits to be allocated for the enhancement coding/decoding, a first number of bits is allocated to a coding/decoding for correcting the core coding/decoding in the first frequency band and according to a first mode of coding/decoding and a second number of bits is allocated to an enhancement coding/decoding for improving the extension coding/decoding in the second frequency band and according to a second mode of coding/decoding. Also provided are an allocation module implementing the method and a coder and decoder including this module.

11 Claims, 8 Drawing Sheets

(51) Int. Cl.

| | |
|---|---|
| ***G10L 19/002*** | (2013.01) |
| *G10L 19/02* | (2013.01) |
| *G10L 19/038* | (2013.01) |

(56) References Cited

U.S. PATENT DOCUMENTS

| | | | | |
|---|---|---|---|---|
| 2010/0017200 | A1* | 1/2010 | Oshikiri et al. | 704/207 |
| 2010/0017204 | A1* | 1/2010 | Oshikiri et al. | 704/222 |

OTHER PUBLICATIONS

Ragot et al. "ITU-T G.729.1: An 8-32 Kbit/s Scalable Coder Interoperable with G.729 for Wideband Telephony and Voice Over IP". IEEE International Conference on Acoustics Speech and Signal Processing (ICASSP) 2007, p. (IV-529)-(IV-532).*

International Search Report and Written Opinion dated Oct. 6, 2010 for corresponding International Application No. PCT/FR2010/051308, filed Jun. 25, 2010.

Mikko Tammi et al., "Scalable Superwideband Extension for Wideband Coding" Acoustics, Speech and Signal Processing, 2009. ICASSP 2009, IEEE International Conference on , IEEE, Piscataway, NJ, USA, Apr. 19, 2009, pp. 161-164, XP031459191.

Ragot S. et al., "ITU-T G. 729.1: An 8-32 Kbit/S Scalable Coder Interoperable with G. 729 for Wideband Telephony and Voice Over IP" 2007 IEEE International Conference on Acoustics, Speech, and Signal Processing Apr. 15-20, 2007 Honolulu, HI, USA, IEEE, Piscataway, NJ, USA, Apr. 15, 2007, pp. IV-529, XP031463903.

International Preliminary Report on Patentability and English translation of Written Opinion dated Feb. 7, 2012 for corresponding International Application No. PCT/FR2010/051308, filed Jun. 25, 2010.

* cited by examiner

ALLOCATION OF BITS IN AN ENHANCEMENT CODING/DECODING FOR IMPROVING A HIERARCHICAL CODING/DECODING OF DIGITAL AUDIO SIGNALS

CROSS-REFERENCE TO RELATED APPLICATIONS

This Application is a Section 371 National Stage Application of International Application No. PCT/FR2010/051308, filed Jun. 25, 2010, which is incorporated by reference in its entirety and published as WO2011/004098 on Jan. 13, 2011, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present disclosure relates to a method of binary allocation for a processing of sound data.

This processing is suited especially to the transmission and/or to the storage of digital signals such as audio frequency signals (speech, music, or the like).

The disclosure applies more particularly to hierarchical coding (or "scalable" coding) which generates a so-called "hierarchical" binary stream since it comprises a core bitrate and one or more improvement layer(s) (the coding standardized according to G.722 at 48, 56 and 64 kbit/s typically being bitrate-scalable, while the UIT-T G.729.1 and MPEG-4 CELP codecs are scalable in terms of both bitrate and bandwidth).

BACKGROUND OF THE DISCLOSURE

Detailed hereinafter is hierarchical coding, having the capability of providing varied bitrates, by apportioning into hierarchized subsets the information relating to an audio signal to be coded, in such a way that this information can be used in order of importance from the standpoint of quality of audio rendition. The criterion taken into account for determining the order is a criterion of optimization (or rather of lesser degradation) of the quality of the coded audio signal. Hierarchical coding is particularly suited to transmission on heterogeneous networks or those exhibiting time-varying available bitrates, or else to transmission destined for terminals exhibiting varying capabilities.

The basic concept of hierarchical (or "scalable") audio coding may be described as follows.

The binary stream comprises a base layer and one or more improvement layers. The base layer is generated by a fixed-bitrate codec, called a "core codec", guaranteeing the minimum quality of the coding. This layer must be received by the decoder to maintain an acceptable quality level. The improvement layers serve to improve the quality. It may, however, happen that they are not all received by the decoder.

The main benefit of hierarchical coding is that it then allows adaptation of the bitrate by simple "truncation of the binary stream". The number of layers (that is to say the number of possible truncations of the binary stream) defines the granularity of the coding. One speaks of "high granularity" coding if the binary stream comprises few layers (of the order of 2 to 4) and of "fine granularity" coding if it allows for example an increment of the order of 1 to 2 kbit/s.

The techniques of bitrate- and bandwidth-scalable coding, with a core coder of CELP type, in the telephonic band and one or more improvement layer(s) in the widened band, are more particularly described hereinafter. An example of such systems is given in the standard UIT-T G.729.1 from 8 to 32 kbit/s with fine granularity. The G.729.1 coding/decoding algorithm is summarized hereinafter.

1. Reminders regarding the G.729.1 coder

The G.729.1 coder is an extension of the UIT-T G.729 coder. It entails a modified G.729-core hierarchical coder producing a signal whose band ranges from the narrow band (50-4000 Hz) to the widened band (50-7000 Hz) with a bitrate of 8 to 32 kbit/s for conversational services. This codec is compatible with existing Voice over IP equipment which uses the G.729 codec.

The G.729.1 coder is shown diagrammatically in FIG. 1. The widened-band input signal $s_{WB}$, sampled at 16 kHz, is firstly decomposed into two sub-bands by QMF ("Quadrature Mirror Filter") filtering. The low band (0-4000 Hz) is obtained by low-pass filtering LP (block 100) and decimation (block 101), and the high band (4000-8000 Hz) by high-pass filtering HP (block 102) and decimation (block 103). The filters LP and HP are of length 64.

The low band is preprocessed by a high-pass filter eliminating the components below 50 Hz (block 104), to obtain the signal $s_{LB}$, before narrow-band CELP coding (block 105) at 8 and 12 kbit/s. This high-pass filtering takes account of the fact that the useful band is defined as covering the interval 50-7000 Hz. The narrow-band CELP coding is a cascade CELP coding comprising as first stage a modified G.729 coding without preprocessing filter and as second stage an additional fixed CELP dictionary.

The high band is firstly preprocessed (block 106) to compensate for the aliasing due to the high-pass filter (block 102) combined with the decimation (block 103). The high band is thereafter filtered by a low-pass filter (block 107) eliminating the components between 3000 and 4000 Hz of the high band (that is to say the components between 7000 and 8000 Hz in the original signal) to obtain the signal $S_{HB}$. A parametric band extension (block 108) is carried out thereafter.

An important feature of the G.729.1 encoder according to FIG. 1 is the following: the error signal $d_{LB}$ of the low band is calculated (block 109) on the basis of the output of the CELP coder (block 105) and a predictive transform coding (of TDAC for "Time Domain Aliasing Cancellation" type in the G.729.1 standard) is carried out at the block 110. With reference to FIG. 1, it is seen in particular that the TDAC encoding is applied both to the error signal on the low band and to the filtered signal on the high band.

Additional parameters may be transmitted by the block 111 to a homologous decoder, this block 111 carrying out a processing termed "FEC" for "Frame Erasure Concealment", with a view to reconstructing erased frames, if any.

The various binary streams generated by the coding blocks 105, 108, 110 and 111 are finally multiplexed and structured as a hierarchical binary train in the multiplexing block 112. The coding is carried out per blocks of samples (or frames) of 20 ms, i.e. 320 samples per frame.

The G.729.1 codec therefore has an architecture as three coding steps comprising:

the cascade CELP coding, the parametric band extension by the module 108, of TDBWE ("Time Domain Bandwidth Extension") type, and a predictive TDAC transform coding, applied after a transformation of MDCT ("Modified Discrete Cosine Transform") type.

2. Reminders regarding the G.729.1 decoder

The G.729.1 decoder is illustrated in FIG. 2. The bits describing each 20-ms frame are demultiplexed in the block 200.

The binary stream of the layers at 8 and 12 kbit/s is used by the CELP decoder (block 201) to generate the narrow-band synthesis (0-4000 Hz). That portion of the binary stream associated with the layer at 14 kbit/s is decoded by the band extension module (block 202). That portion of the binary stream associated with the bitrates above 14 kbit/s is decoded by the TDAC module (block 203). A processing of the pre-echoes and post-echoes is carried out by the blocks 204 and 207 as well as an enhancement (block 205) and a post-processing of the low band (block 206).

The widened-band output signal $\hat{s}_{wb}$, sampled at 16 kHz, is obtained by way of the bank of synthesis QMF filters (blocks 209, 210, 211, 212 and 213) integrating the inverse aliasing (block 208).

The description of the transform-coding layer is detailed hereinafter.

3. Reminders regarding the TDAC transform based coder in the G.729.1 coder

The transform coding of TDAC type in the G.729.1 coder is illustrated in FIG. 3.

The filter $W_{LB}(z)$ (block 300) is a perceptual weighting filter, with gain compensation, applied to the low-band error signal $d_{LB}$. MDCT transforms are thereafter calculated (block 301 and 302) to obtain:

the MDCT spectrum $D_{LB}^{w}$ of the difference signal, perceptually filtered, and the MDCT spectrum $S_{HB}$ of the original signal of the high band.

These MDCT transforms (blocks 301 and 302) are applied to 20 ms of signal sampled at 8 kHz (160 coefficients). The spectrum Y(k) arising from the fusion block 303 thus comprises 2×160, i.e. 320 coefficients. It is defined as follows:

$$[Y(0)Y(1) \ldots Y(319)]=[D_{LB}^{w}(0)D_{LB}^{w}(1) \ldots D_{LB}^{w}(159)S_{HB}(0)S_{HB}(1) \ldots S_{HB}(159)]$$

This spectrum is divided into eighteen sub-bands, a sub-band j being assigned a number denoted nb_coef(j) of coefficients. The slicing into sub-bands is specified in table 1 hereinafter.

Thus, a sub-band j comprises the coefficients Y(k) with sb_bound(j)≤k<sb_bound(j+1).

Note that the coefficients 280-319 corresponding to the 7000 Hz-8000 Hz frequency band are not coded; they are set to zero at the decoder, since the passband of the codec is from 50-7000 Hz.

TABLE 1

Limits and size of the sub-bands in TDAC coding

| J | sb _bound (j) | nb_coef (j) |
|---|---|---|
| 0 | 0 | 16 |
| 1 | 16 | 16 |
| 2 | 32 | 16 |
| 3 | 48 | 16 |

TABLE 1-continued

Limits and size of the sub-bands in TDAC coding

| J | sb _bound (j) | nb_coef (j) |
|---|---|---|
| 4 | 64 | 16 |
| 5 | 80 | 16 |
| 6 | 96 | 16 |
| 7 | 112 | 16 |
| 8 | 128 | 16 |
| 9 | 144 | 16 |
| 10 | 160 | 16 |
| 11 | 176 | 16 |
| 12 | 192 | 16 |
| 13 | 208 | 16 |
| 14 | 224 | 16 |
| 15 | 240 | 16 |
| 16 | 256 | 16 |
| 17 | 272 | 8 |
| 18 | 280 | — |

The spectral envelope $\{\log_rms(j)\}_{j=0,\ldots,17}$ is calculated in the block 304 according to the formula:

$$\log_rms(j) = \frac{1}{2}\log_2\left[\frac{1}{nb_coef(j)}\sum_{k=sb_bound(j)}^{sb_bound(j+1)-1} Y(k)^2 + \varepsilon_{rms}\right],$$

j=0, . . . , 17 where $\epsilon_{rms}=2^{-24}$.

The spectral envelope is coded at variable bitrate in the block 305. This block 305 produces quantized, integer values, denoted rms_index(j) (with j=0, . . . , 17), obtained by simple scalar quantization:

$$rms_index(j)=round(2\cdot\log_rms(j))$$

where the notation "round" designates rounding to the nearest integer, and with the constraint:

$$-11 \le rms_index(j) \le +20$$

This quantized value rms_index(j) is transmitted to the bit allocation block 306.

The coding of the spectral envelope, itself, is further performed by the block 305, separately for the low band (rms_index(j), with j=0, . . . , 9) and for the high band (rms_index(j), with j=10, . . . , 17). In each band, two types of coding may be chosen according to a given criterion, and, more precisely, the values rms_index(j):

may be coded by so-called "differential Huffman" coding, or may be coded by natural binary coding.

A bit (0 or 1) is transmitted to the decoder to indicate the mode of coding which has been chosen.

The number of bits allocated to each sub-band for its quantization is determined at the block 306 on the basis of the quantized spectral envelope arising from the block 305.

The bit allocation performed minimizes the quadratic error while adhering to the constraint of an integer number of bits allocated per sub-band and of a maximum number of bits not to be exceeded. The spectral content of the sub-bands is thereafter coded by spherical vector quantization (block 307).

The various binary streams generated by the blocks 305 and 307 are thereafter multiplexed and structured as a hierarchical binary train at the multiplexing block 308.

4. Reminder regarding the transform based decoder in the G.729.1 decoder

The step of TDAC type transform based decoding in the G.729.1 decoder is illustrated in FIG. 4.

In a symmetric manner to the encoder (FIG. 3), the decoded spectral envelope (block 401) makes it possible to retrieve the allocation of bits (block 402). The envelope decoding (block 401) reconstructs the quantized values of the spectral envelope (rms_index(j), for j=0, . . . , 17), on the basis of the binary train generated by the block 305 (multiplexed) and deduces therefrom the decoded envelope:

$$rms_q(j)=2^{1/2\ rms_index(j)}$$

The spectral content of each of the sub-bands is retrieved by inverse spherical vector quantization (block 403). The untransmitted sub-bands, for lack of sufficient "budget" of bits, are extrapolated (block 404) on the basis of the MDCT transform of the signal output by the band extension block (block 202 of FIG. 2).

After upgrading of this spectrum (block 405) as a function of the spectral envelope and post-processing (block 406), the MDCT spectrum is split into two (block 407):

with 160 first coefficients corresponding to the spectrum $\hat{D}_{LB}^{w}$ of the perceptually filtered, low-band decoded difference signal, and 160 subsequent coefficients corresponding to the spectrum $\hat{S}_{HB}$ of the high-band decoded original signal.

These two spectra are transformed into temporal signals by inverse MDCT transform, denoted IMDCT (blocks 408 and 410), and the inverse perceptual weighting (filter denoted $W_{LB}(z)^{-1}$) is applied to the signal $\hat{d}_{LB}^{w}$ (block 409) resulting from the inverse transform.

The allocation of bits to the sub-bands (block 306 of FIG. 3 or block 402 of FIG. 4) is more particularly described hereinafter.

The blocks 306 and 402 carry out an identical operation on the basis of the values rms_index(j), j=0, . . . , 17. Therefore, hereinafter merely the operation of the block 306 is described.

The aim of the binary allocation is to apportion between each of the sub-bands a certain (variable) budget of bits, denoted nbits_VQ, with:

nbits_VQ=351−nbits_rms, where nbits_rms is the number of bits used by the coding of the spectral envelope.

The result of the allocation is the integer number of bits, denoted nbit(j) (with j=0, . . . , 17), allocated to each of the sub-bands with, as overall constraint:

$$\sum_{j=0}^{17} nbit(j) \le \text{nbits_VQ}$$

In the G.729.1 standard, the values nbit(j) (j=0, . . . , 17), are moreover constrained by the fact that nbit(j) must be chosen from among a reduced set of values specified in table 2 hereinafter.

TABLE 2

Possible values of number of bits allocated in the TDAC sub-bands.

| Size of the sub-band j nb_coef(j) | Set of authorized values nbit(j) (in number of bits) |
|---|---|
| 8 | $R_8 = \{0, 7, 10, 12, 13, 14, 15, 16\}$ |
| 16 | $R_{16} = \{0, 9, 14, 16, 17, 18, 19, 20, 21, 22, 23, 24, 25, 26, 27, 28, 29, 30, 31, 32\}$ |

The allocation in the G.729.1 standard relies on a "perceptual importance" per sub-band related to the energy of the sub-band, denoted ip(j)(j=0 . . . 17), defined as follows:

$$ip(j) = \frac{1}{2}\log_2(\text{rms_q}(j)^2 \times \text{nb_coef}(j)) + \text{offset}$$

where offset = −2.

Since the values rms_q(j)=$2^{1/2\ rms_index(j)}$, this formula simplifies to the form:

$$ip(j) = \begin{cases} \frac{1}{2}\text{rms_index}(j) & \text{for } j = 0, \ldots, 16 \\ \frac{1}{2}(\text{rms_index}(j) - 1) & \text{for } j = 17 \end{cases}$$

On the basis of the perceptual importance of each sub-band, the allocation nbit(j) is calculated as follows:

$$nbit(j) = \arg \min_{r \in R_{nb_coef(j)}} |\text{nb_coef}(j) \times (ip(j) - \lambda_{opt}) - r|$$

where $\lambda_{opt}$ is a parameter optimized by dichotomy to satisfy the overall constraint $$\sum_{j=0}^{17} nbit(j) \le \text{nbits_VQ}$$

by best approximating the threshold nbits_VQ.

New initiatives for extending a core coder of G.729.1 type such as described hereinabove or of G.718 type to super widened band (SWB for "Super Wide Band"), are currently undergoing discussion.

A possible extension solution is described for example in the document by the authors M. Tammi, L. Laaksonen, A. Rämö, H. Toukomaa, entitled "Scalable Superwideband Extension for Wideband Coding", ICASSP, 2009.

This document describes a super-widened band coding/decoding system comprising a core coding stage of G.729.1 or G.718 type and a band extension stage.

The core coding performs the coding of the frequency band ranging from 0 to 7 kHz whereas the extension band performs a coding in the frequency band ranging from 7 to 14 kHz.

A first extension coding layer is based on a parametric model relying on two modes of coding: a generic mode and a sinusoidal mode.

The generic mode uses a procedure for transposition in the MDCT domain for artificially generating the high-frequency (7-14 kHz) MDCT coefficients on the basis of the low frequencies (0-7 kHz). The low frequency band making it possible to code a high frequency band is selected on a criterion for maximizing the normalized correlation.

The sinusoidal mode is normally used for particularly harmonic or tonal signals. In this mode, the highest-energy components are selected. Their positions, their amplitudes and their signs are then transmitted.

This first layer is transmitted with a bitrate of 4 kbit/s. In this article, a second layer for improving the 7-14 kHz band is proposed, it is based on the coding of extra sinusoids making it possible to best approximate the MDCT spectrum of the input signal. The allocation of bits for this second extension layer is fixed once and for all.

Thus, the extension coding presented in this document improves the signal only in the extension frequency band ranging from 7 to 14 kHz. The frequency band from 0 to 7 kHz of the core coding is not modified.

It may happen, however, that certain frequency sub-bands of the core frequency band do not receive sufficient bitrate.

In the case where 0 bit is allocated to a core coding sub-band, the decoder then makes direct use of the synthesized signal arising from the first band extension coding layer TDBWE for the 4-7 kHz band, to fill in the unallocated bands.

It turns out, however, that these bands may sometimes penalize the perceived quality when the coder is combined with a 7-14 kHz band extension module.

Indeed, the addition of the high frequencies sometimes increases the perception of defects arising from the low frequencies.

Thus, a band extension may accentuate the core layer coding defects.

There therefore exists a requirement for overall improvement to the quality of the coded signal on the whole of the frequency band and not only on the extension frequency band.

SUMMARY

An exemplary embodiment of the present disclosure relates to a method of binary allocation in an improvement coding/decoding for enhancing a hierarchical coding/decoding of digital audio signals comprising a core coding/decoding in a first frequency band and a band extension coding/decoding in a second frequency band. The method is such that, for a predetermined number of bits to be allocated for the improvement coding/decoding, a first number of bits (nbit_enhanced(j)) is allocated to a coding/decoding for correcting the core coding/decoding in the first frequency band and according to a first mode of coding/decoding and a second number of bits (nb_sin) is allocated to a coding/decoding for improving the extension coding/decoding in the second frequency band and according to a second mode of coding/decoding.

Thus, the allocation method according to one embodiment of the invention makes it possible while performing an improvement of the frequency band extension coding for a core coding, to allocate additional bits so as also to correct the core coding in the first frequency band.

This makes it possible to obtain a good compromise between the improvement coding for the core coding and that for the extension band. This compromise is obtained in an adaptive manner so as to best adapt to the signal to be coded and to the coding format implemented.

The overall quality of the coded signal is thus improved.

The various particular embodiments mentioned hereinafter may be added independently or in combination with one another, to the steps of the above-defined allocation method.

In a particular embodiment, the method comprises the following steps:

obtaining of the allocated number of bits (nbit(j)) for the core coding/decoding, per frequency sub-band of the first frequency band;

in the frequency sub-bands where the allocated number of bits for the core coding/decoding does not exceed a predetermined threshold, allocation of a number of bits per sub-band, constituting the first number of bits for the coding/decoding for correcting the core coding/decoding;

allocation of the second allocated number of bits for the coding/decoding for improving the extension coding/decoding, as a function of the first allocated number of bits and of the predetermined number of bits to be allocated.

Thus, for the frequency sub-bands of the core coding which have received only very little allocation of bits, the allocation according to one embodiment of the invention makes it possible to allocate additional bits for these frequency sub-bands so as to improve the core coding in these sub-bands and to do so while also guaranteeing an improvement for the extension coding.

In a particular embodiment, a minimum number of bits is fixed per frequency sub-band for the allocation of the first number of bits.

Thus, each frequency sub-band has a guaranteed associated bitrate and therefore a guaranteed coding.

In a simple manner, the predetermined threshold is fixed at 0.

In a variant embodiment, the predetermined threshold is greater than 0 and if the first allocated number of bits is greater than the predetermined number of bits, the value of the threshold is reduced.

The allocation is better adapted to the signal, a maximum correction of the core coding then being performed so as to best optimize the allocated bitrate. This optimization is done on the go by adapting the threshold.

In a particular embodiment, the method comprises a step of receiving tonality information for a residual signal resulting from a difference between a signal arising from a first band extension layer and the original signal and in the case of a tonal residual signal, the second allocated number of bits for the coding/decoding for improving the band extension is bigger than the first number. In a variant, this tonality information is calculated directly on the original signal, for example by detecting an energy spike in the spectrum.

Thus the band extension improvement layer is adapted to the type of signal that it has to code. The coding according to the extension coding mode being particularly adapted to the signal of tonal type, priority is thus given to this mode of coding.

In a particularly adapted application of an embodiment of the invention, the core coding/decoding is of G.729.1 standardized coding/decoding type, the first mode of coding/decoding being a transform coding/decoding and the second mode of coding/decoding being a parametric coding/decoding.

An embodiment of the present invention also pertains to a module for binary allocation in a coder/decoder for improving a hierarchical coder/decoder of digital audio signals comprising a module for core coding/decoding in a first frequency band and a module for band extension coding/decoding in a second frequency band. This allocation module comprises:

means for allocating a first number of bits (nbit_enhanced (j)) to a coding/decoding module for correcting the core coder/decoder in the first frequency band and according to a first mode of coding/decoding, for a predetermined number of bits to be allocated for the improvement coder/decoder, and means for allocating a second number of bits (nb_sin) to a coding/decoding module for improving the extension coder/decoder in the second frequency band and according to a second mode of coding/decoding.

An embodiment of the invention pertains to a hierarchical coder comprising an allocation module according to the invention.

An embodiment of the invention also pertains to a hierarchical decoder comprising an allocation module according to the invention.

Finally an embodiment of, the invention pertains to a computer program comprising code instructions for the implementation of the steps of an allocation method according to the invention, when they are executed by a processor.

BRIEF DESCRIPTION OF THE DRAWINGS

Other characteristics and advantages will be more clearly apparent on reading the following description, given solely by way of nonlimiting example, and with reference to the appended drawings in which.

DETAILED DESCRIPTION OF ILLUSTRATIVE EMBODIMENTS

A possible application of an embodiment of the invention to an extension of the G.729.1 encoder, in particular to super-widened band, is now described.

Figure 5:
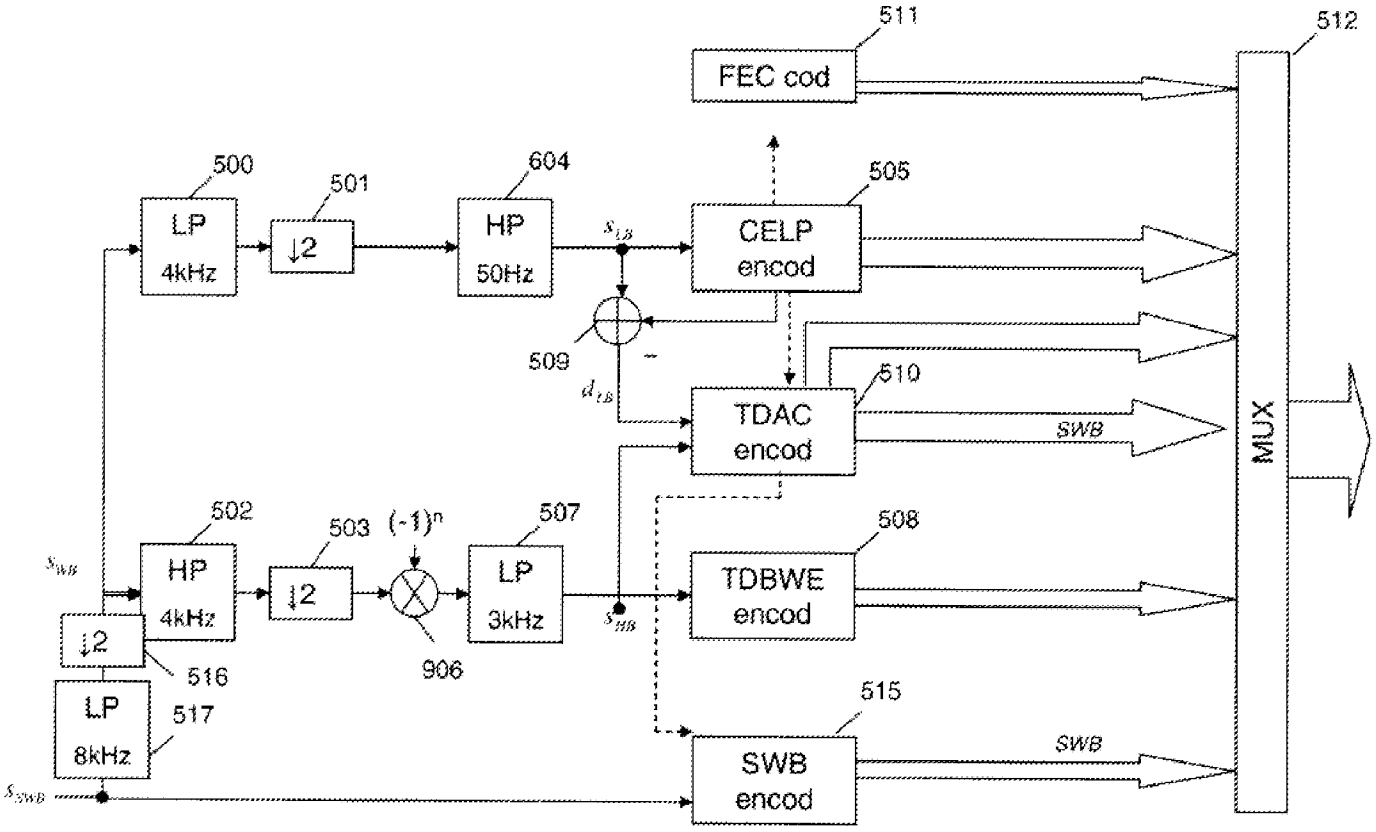
FIG. 5 illustrates the structure of a frequency band extended G.729.1 coder in which an embodiment of the invention may be implemented.

With reference to FIG. 5, a super-widened band extension of a core coder of G.729.1 type including the invention according to one embodiment, is now described.

Such a coder such as represented consists of an extension of the frequencies coded by the module 515, the frequency band used going from [50 Hz-7 kHz] to [50 Hz-14 kHz] and of an improvement of the base layer of the G.729.1 by the TDAC coding module (block 510) and such as described subsequently with reference to FIG. 7.

Figure 1:
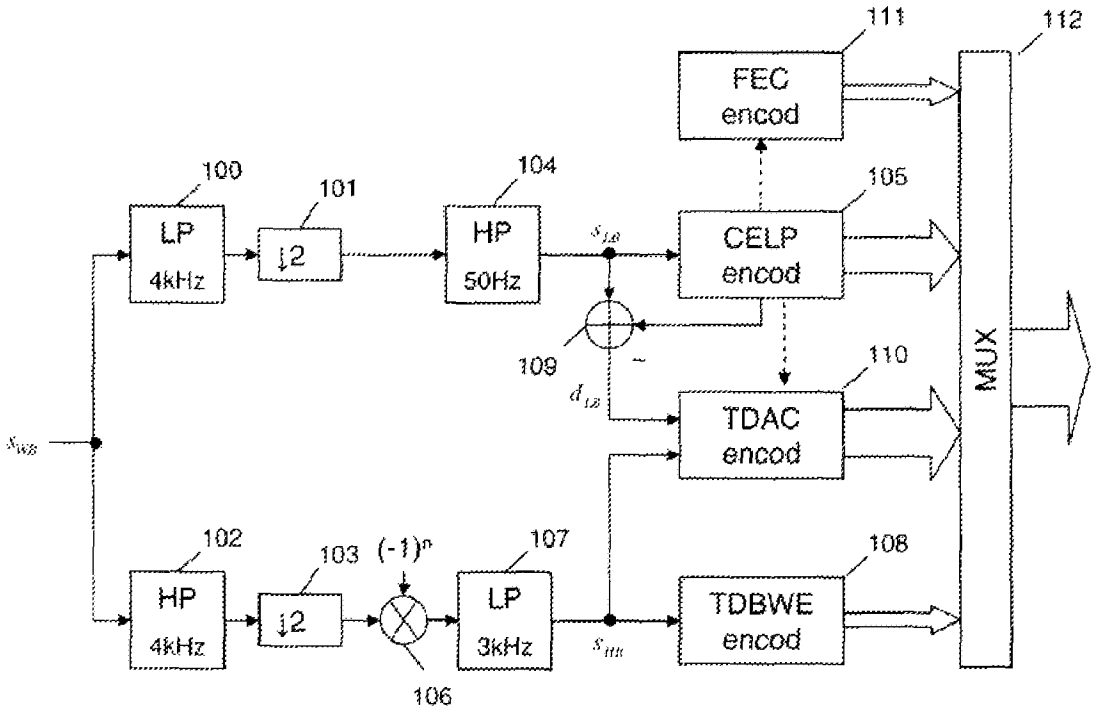
FIG. 1 illustrates the structure of a previously described coder of G.729.1 type.

The coder such as represented in FIG. 5, comprises the same modules as the G.729.1 core coding represented in FIG. 1 and an additional module for band extension 515 which provides the multiplexing module 512 with an extension signal.

This extension coding module 515 operates in the frequency band ranging from 7 to 14 kHz, termed the second frequency band with respect to the first frequency band ranging from 0 to 7 kHz of the core coding.

This frequency band extension is calculated on the full band original signal $S_{SWB}$ whereas the input signal for the core coder is obtained by decimation (block 516) and low-pass filtering (block 517). At the output of these blocks, the widened-band input signal $S_{WB}$ is obtained.

The module 515 comprises a first extension coding layer based on a parametric model relying on two modes of coding, a generic mode and a sinusoidal mode, depending on whether the original signal $S_{WB}$ is tonal or non-tonal as described in the document by M. Tammi, L. Laaksonen, A. Rämö, H. Toukomaa, entitled "Scalable Superwideband Extension for Wideband Coding", ICASSP, 2009.

It also comprises a coding layer for improving this first coding layer by a coding in sinusoidal mode and whose bit allocation is performed according to a bit allocation method such as described with reference to FIG. 7.

Accordingly, the extension module 515 receives information from the TDAC coder 510, especially, the number of bits allocated in the frequency sub-bands of the core coding.

Figure 7:
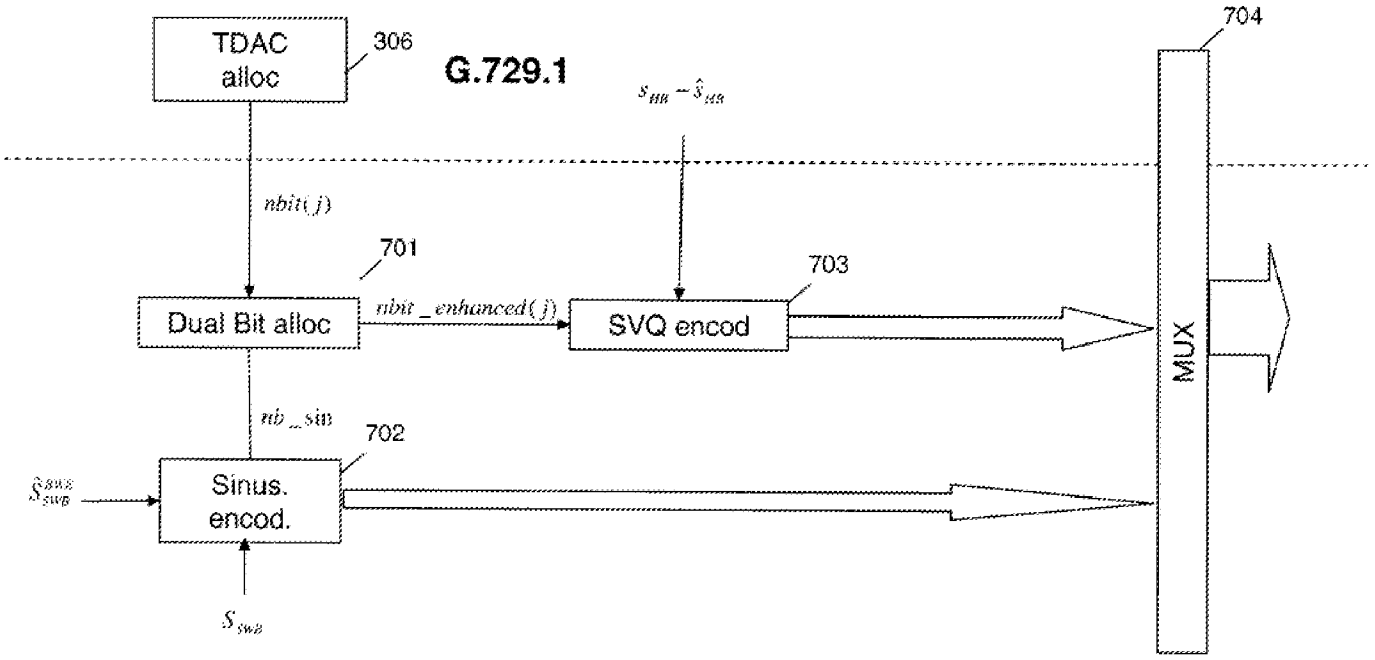
FIG. 7 illustrates an improvement coder comprising a module for allocating bits implementing an allocation method according to one embodiment of the invention.

In a possible embodiment, the allocation module such as described subsequently with reference to FIG. 7, is integrated into the extension module 515.

In another embodiment, this module is integrated into the TDAC module 510. In yet another embodiment, this module is independent of the two modules 510 and 515 and communicates the bit allocation results to the two respective modules.

Thus according to an embodiment of the invention, a module for allocating bits allocates a first number of bits to a coding for correcting the core coding in the first frequency band and according to a first mode of coding, in the present case, a transform coding. This allocation is performed according to a predetermined number of bits to be allocated for the improvement coding.

The module allocates a second number of bits to a coding for improving the extension coding in the second frequency band and according to a second mode of coding, here the sinusoidal parametric mode.

When the models of the core coding and of the band extension are different, bitrate allocation between these two models may turn out to be difficult. Indeed, there will generally be a waveform coding model for the core, for example a transform coder which attempts to best code the original signal. For the band extension, parametric models are more generally used, their aim being to represent the high frequencies perceptually without however endeavoring to faithfully code the waveform.

The bitrate allocation between the two models may in this case be difficult. The improvement criteria for the core coder and for the band extension are different and it is difficult to compare them.

This allocation will be detailed subsequently with reference to FIG. 7.

Thus, the TDAC coding module 510 receives an additional allocation of bits so as to perform a core coding correction in a certain number of sub-bands. In addition to the core coded signal, it provides the multiplexing module with additional bits for the core coding correction coding.

Figure 2:
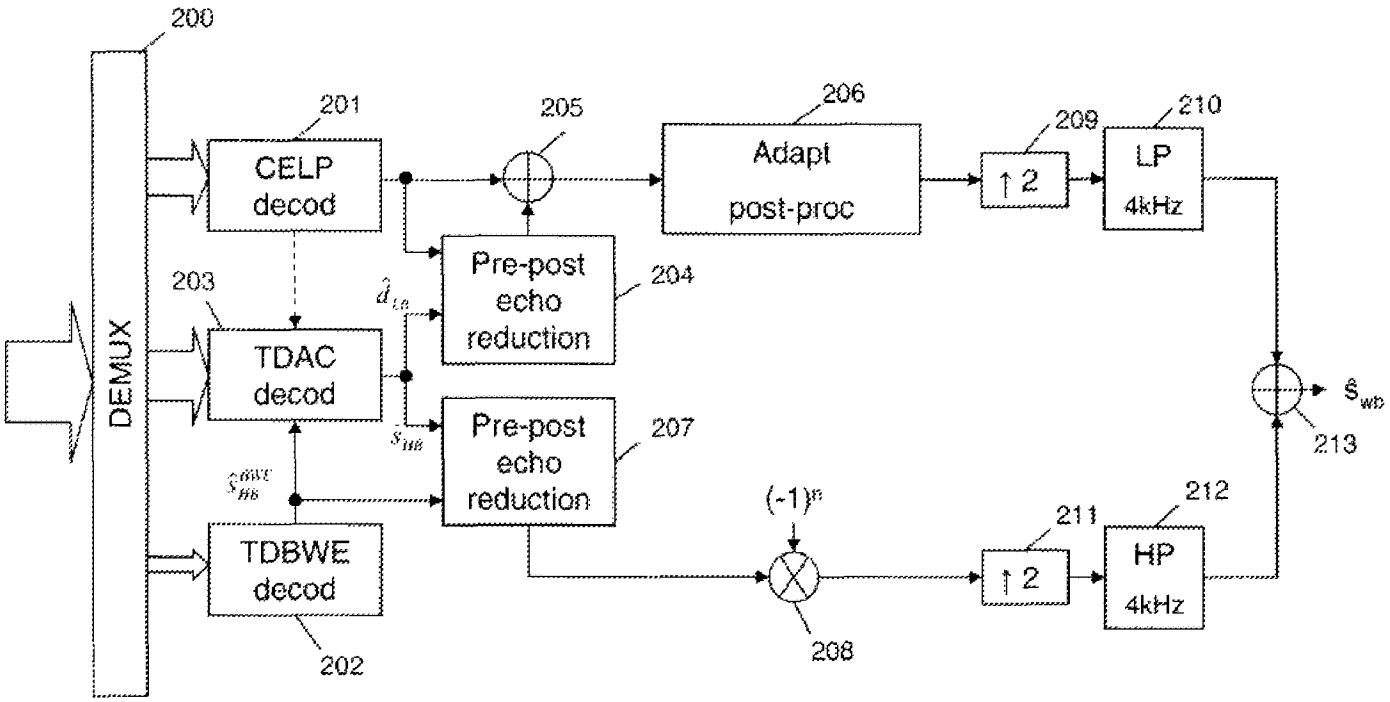
FIG. 2 illustrates the structure of a previously described decoder of G.729.1 type.
Figure 6:
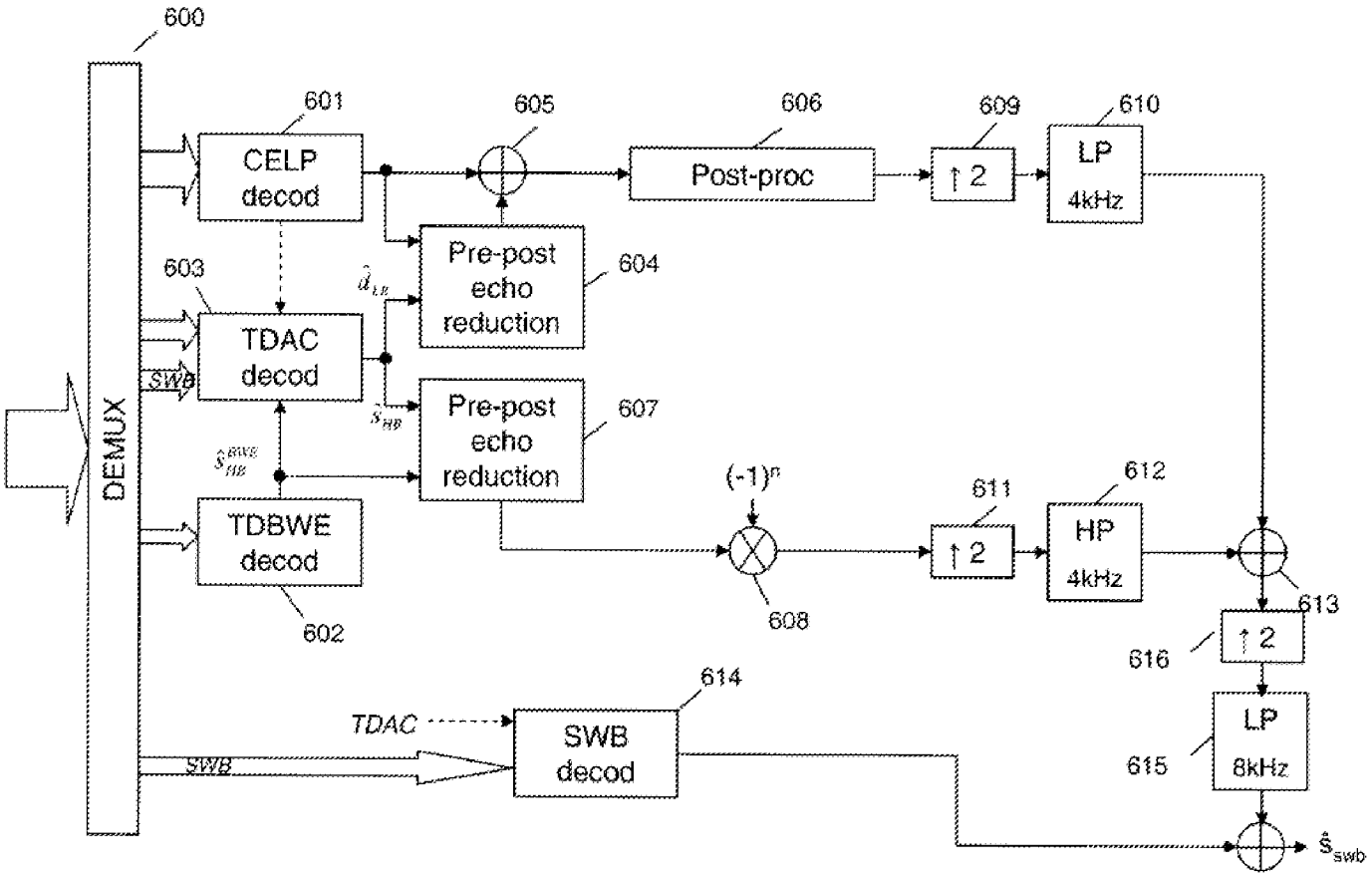
FIG. 6 illustrates the structure of a frequency band extended G.729.1 decoder in which an embodiment of the invention may be implemented.

In the same manner, a G.729.1 decoder in super-widened mode is described with reference to FIG. 6. It comprises the same modules as the G.729.1 decoder described with reference to FIG. 2.

It comprises, however, an additional module for band extension 614 which receives from the demultiplexing module 600, the band extension signal as well as the improvement signal for the extension coding according to the allocation defined by the allocation module described with reference to FIG. 7. The decoder also comprises the bank of synthesis filters (blocks 616, 615) making it possible to obtain the super-widened band output signal $\hat{S}_{SWb}$.

The TDAC decoding module 603 receives from the multiplexing module, in addition to the coded core signal, additional bits for correcting the core coding according to the allocation of bits defined by the allocation module described with reference to FIG. 7.

The decoder thus described therefore benefits from the improvement coding implemented by the improvement coder such as now described with reference to FIG. 7.

In one embodiment, the binary allocation cannot be recalculated at the decoder, this information is then transmitted in the corresponding improvement layer.

In another embodiment, the decoder can perform the same binary allocation calculation as at the coder by apportioning the bitrate between the correction of the core coder and the band extension. The allocation module relies on the binary allocation of the core coder and optionally on an item of information coming from the first band extension layer, namely the tonality indication.

An allocation module as described with reference to FIG. 7, implements the allocation method according to an embodiment of the invention.

This module can, in the same manner as for the coder, be integrated into the TDAC decoder module 603, into the extension module 614 or be independent.

FIG. 7 represents a module for allocating bits 701, which employs the main steps of a method for allocating bits according to an embodiment of the invention.

Figure 3:
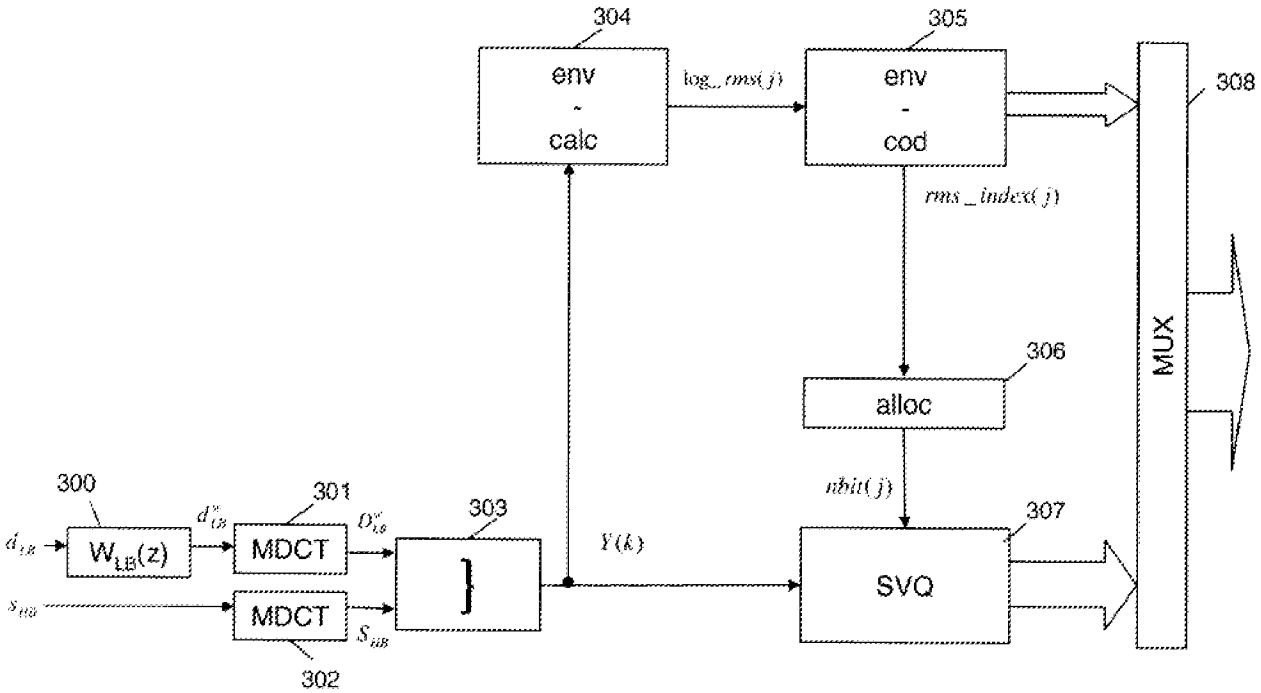
FIG. 3 illustrates the structure of a previously described TDAC coder included in the coder of G.729.1 type.
Figure 4:
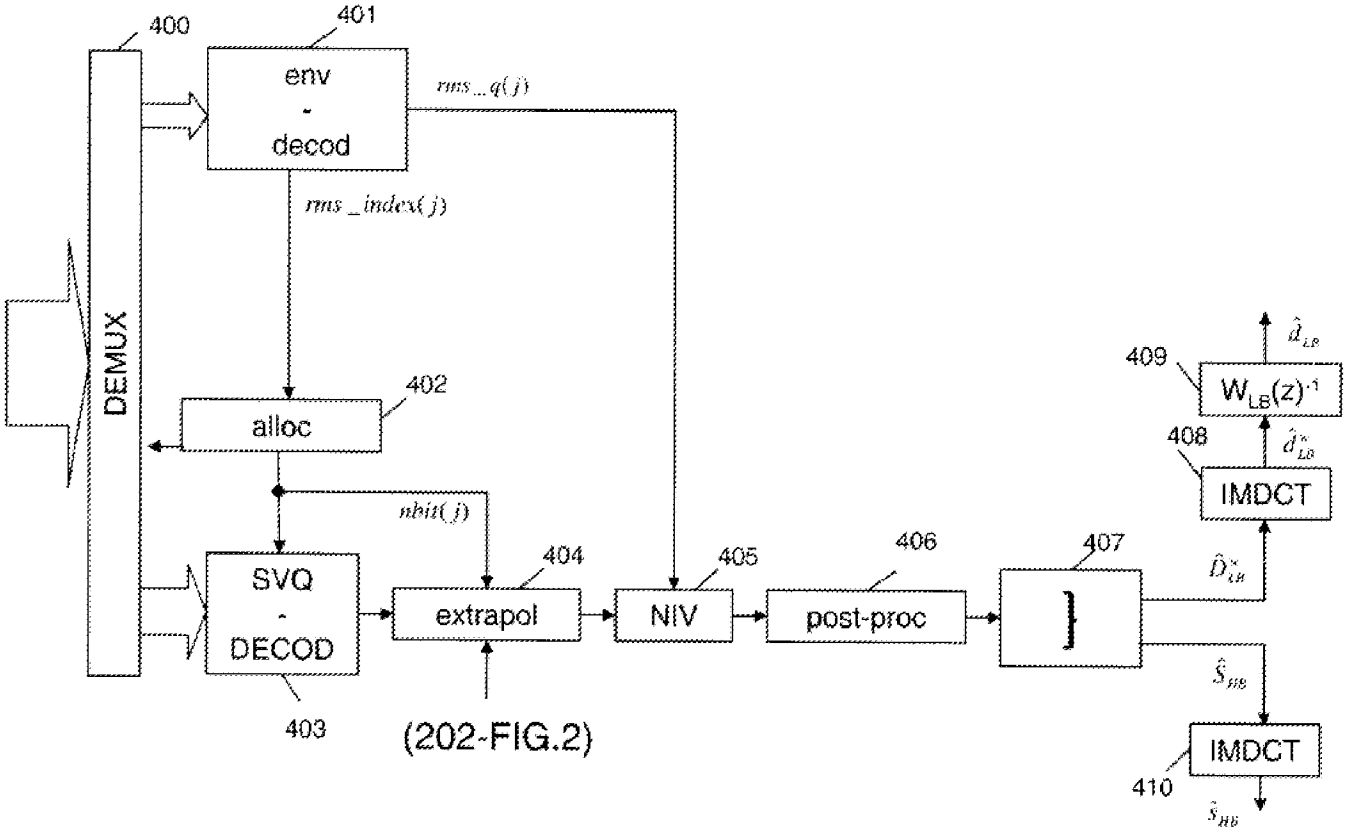
FIG. 4 illustrates the structure of a TDAC decoder such as previously described, included in a decoder of G.729.1 type.

The block 306 represented in FIG. 7 corresponds to the block for allocating bits for the core coding and such as described in the TDAC coder of FIG. 3, for the G.729.1 core coding.

This core allocation block delivers an item of information regarding allocation of bits nbit(j) of the core coding, per frequency sub-band of the core frequency band.

This information is received by the module 701 for jointly allocating bits. As a function of an available bitrate for the improvement coding, the module 701 allocates a first number of bits nbit_enhanced(j) so as to perform a correction of the core coding of transform type in a first frequency band and a second number of bits nb_sin for the coding of sinusoidal parametric type, for improving the extension coding in a second frequency band.

More particularly, the module 701 receives a number of bits allocated for the core coding for each of the sub-bands of the first frequency band.

This number of bits per sub-band is compared with a predetermined threshold. In the frequency sub-bands where the allocated number of bits is below the threshold, the module 701 allocates a minimum number of bits of a predefined value, for example 9 bits.

The remaining available bits with respect to the authorized bitrate for the improvement coding, for example an authorized bitrate of 4 kbit/s, are allocated for the extension coding improvement coding, that is to say the second extension coding layer such as described with reference to FIG. 5.

In a simple manner, the threshold may be fixed at 0. Thus, only the frequency sub-bands which have not received any bitrate, have an additional allocation of bits to correct the core coding in these sub-bands.

In a variant embodiment, the predetermined threshold is greater than 0. A first trial is performed with a minimum number of bits to be allocated for the sub-bands which have an allocation below this threshold. In the case where numerous sub-bands have an allocation of bits below the threshold, it may happen that the available bitrate is exceeded. In this case, the threshold is decreased so as to perform a second trial. This decrease can be effected for example by dichotomy, until a threshold is found which makes it possible to allocate the minimum number of bits per sub-band.

The number of remaining bits is then allocated for the band extension sinusoidal coding. It corresponds to the number of sinusoids which may be coded for the extension coding improvement coding.

The allocation module 701 therefore provides a first allocation of bits per sub-band, nbit-enhanced(j) to a coding block for correcting the core coding 703 which performs a spherical vector quantization of a residual signal arising from the spherical vector quantization of the TDAC coder of the G.729.1 core coding, $\hat{S}_{HB}$ and the original signal $s_{HB}$.

The correction coding block 703 thus delivers to the multiplexer block 704, a correction signal for the core coding according to the allocated number of bits for this coding.

The allocation module 701 delivers a second allocation of bits nb_sin to a coding block 702 for improving the band extension coding.

This coding block receives the signal of the first band extension layer $\hat{S}_{SWB}^{BWE}$ as well as the original signal $S_{SWB}$ and codes the residual signal arising from the difference calculation for these two signals.

In a variant embodiment, the module 701 also receives an item of information regarding tonality of the residual signal. This tonality calculation is given for example in the document ICASSP 2009 referenced hereinabove.

The coded improvement signal arising from the block 702 is transmitted to the multiplexing block 704 according to the bit allocation determined by the allocation method.

The improvement coding illustrated in this FIG. 7 is for example integrated into a super-widened band G.729.1 coder such as described with reference to FIG. 5.

The allocation module is for example situated in the band extension module 515. It receives the core coding allocation information from the TDAC 510. It transmits the first number of bits allocated to the TDAC coder which performs the spherical vector quantization of the block 703. It transmits the second allocated number of bits for the sinusoidal-mode coding of the block 702 to the second coding layer for the extension module 515.

In a variant embodiment, this module for allocating bits is integrated into the TDAC module 510 of FIG. 5. It delivers the first number of bits allocated to the quantization block for the TDAC coder and the second number of bits allocated to the extension module 515 for the improvement coding for the block 702.

In yet another variant, the allocation module is independent of the modules 510 and 515 and dispatches respectively to the two modules, the first allocated number of bits and the second allocated number of bits.

An embodiment of the invention has been described here in respect of a super-widened band G.729.1 coder.

It can quite obviously be integrated into a widened band coder of G.718 type or into any other hierarchical coder having a core coding in a first frequency band and an improvement coding in a second frequency band.

This FIG. 7 represents the improvement coding stage. For the improvement decoding, the same operations may be performed. An allocation module 701 then gives the number of bits nbit_enhanced(j) for the improvement decoding (SVQ decod) of the core decoding carried out for example in the TDAC decoding module 603 of FIG. 6 and the number of bits nb_sin for the extension layer improvement decoding (sine decod), carried out for example by the extension decoding module 614 of FIG. 6.

An example of a hardware embodiment of an allocation module such as represented and described with reference to FIG. 7 is now described with reference to FIG. 8.

Figure 8:
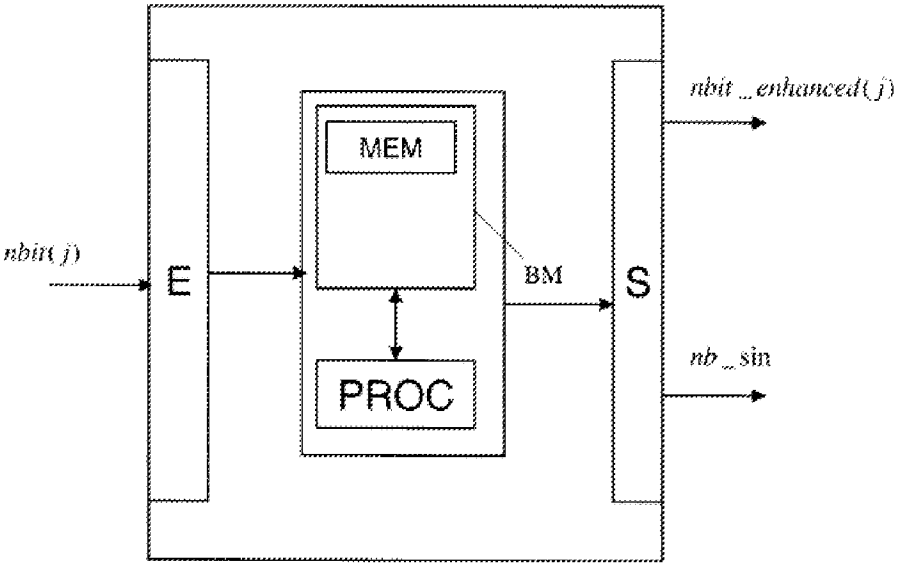
FIG. 8 illustrates an example of a hardware embodiment of an allocation module according to an embodiment of the invention.

Thus, FIG. 8 illustrates an allocation module comprising a processor PROC cooperating with a memory block BM comprising a storage and/or work memory MEM.

This module comprises an input module able to receive a number of bits per sub-band nbit(j) of the first frequency band of a core coder.

The memory block BM can advantageously comprise a computer program comprising code instructions for the implementation of the steps of the allocation method within an embodiment of the invention, when these instructions are executed by the processor PROC, and especially the steps, for a predetermined number of bits to be allocated for an improvement coding/decoding:

of allocation of a first number of bits to a coding/decoding for correcting the core coding/decoding in the first frequency band and according to a first mode of coding/decoding;

of allocation of a second number of bits to a coding/decoding for improving the extension coding/decoding in the second frequency band and according to a second mode of coding/decoding.

Typically, the description of FIG. 7 employs the steps of an algorithm of a computer program such as this. The computer program can also be stored on a memory medium readable by a reader of the module or of a coder integrating the allocation module or downloadable into the memory space of the latter.

The allocation module comprises an output module able to transmit the first number of bits nbit_enhanced(j) allocated for the core coding correction coding and a second number of bits nb_sin for the extension coding improvement coding.

This allocation module may be integrated into a super-widened band hierarchical coder/decoder of G.729.1 type or more generally into any hierarchical coder/decoder with frequency band extension.

The invention claimed is:

1. A method of binary allocation in an improvement coding or decoding for enhancing a hierarchical coding or decoding of digital audio signals, the method comprising:

a core coding or decoding of the digital audio signals in a first frequency band by a core coder or decoder device; and a band extension coding or decoding of the digital audio signals in a second frequency band by a band extension coder or decoder device, wherein, for a predetermined number of bits to be allocated for the improvement coding or decoding, a first number of bits is allocated to a correcting coding or decoding for improving the core coding or decoding in the first frequency band and according to a first mode of coding or decoding and a second number of bits is allocated to the band extension coding or decoding for improving the band extension coding or decoding in the second frequency band and according to a second mode of coding or decoding.

2. The method as claimed in claim 1, wherein the method comprises the following steps:

obtaining the allocated number of bits for the core coding or decoding, per frequency sub-band of the first frequency band;

in the frequency sub-bands where the allocated number of bits for the core coding or decoding does not exceed a predetermined threshold, allocating a number of bits per sub-band, constituting the first number of bits for the coding or decoding for correcting the core coding or decoding; and allocating the second allocated number of bits for the coding or decoding for improving the extension coding or decoding, as a function of the first allocated number of bits and of the predetermined number of bits to be allocated.

3. The method as claimed in claim 2, wherein a minimum number of bits is fixed per frequency sub-band for the allocation of the first number of bits.

4. The method as claimed in claim 2, wherein the predetermined threshold is fixed at 0.

5. The method as claimed in claim 3, wherein the predetermined threshold is greater than 0 and if the allocated first number of bits is greater than the predetermined number of bits, the value of the threshold is reduced.

6. The method as claimed in claim 2, wherein the method comprises a step of receiving tonality information for a residual signal resulting from a difference between a signal arising from a first extension layer and the original signal and in the case of a tonal residual signal, the allocated second number of bits for the coding or decoding for improving the band extension is bigger than the first number.

7. The method as claimed in claim 1, wherein the core coding or decoding comprises a G.729.1 standardized coding or decoding type, the first mode of coding or decoding being a transform coding or decoding and the second mode of coding or decoding being a parametric coding or decoding.

8. An improvement coder or decoder device for improving a hierarchical coding or decoding of digital audio signals, comprising:

a core coder or decoder configured to code or decode the digital audio signals in a first frequency band;

a band extension coder or decoder configured to code or decode the digital audio signals in a second frequency band;

an allocation module configured to allocate a first number of bits to the core coder or decoder for improving the core coding or decoding in the first frequency band and according to a first mode of coding or decoding, for a predetermined number of bits to be allocated for the improvement coder or decoder, and an allocation module configured to allocate a second number of bits to the band extension coder or decoder for improving the band extension coding or decoding in the second frequency band and according to a second mode of coding or decoding.

9. A hierarchical coder device, which comprises an improvement coder or decoder device as claimed in claim 8.

10. A hierarchical decoder device, which comprises an improvement coder or decoder device as claimed in claim 8.

11. A non-transitory computer-readable medium comprising a computer program stored thereon and comprising code instructions for implementing a method of binary allocation in an improvement coding or decoding for enhancing a hierarchical coding or decoding of digital audio signals, when the instructions are executed by a processor, wherein the method comprises:

a core coding or decoding of the digital audio signals in a first frequency band; and a band extension coding or decoding of the digital audio signals in a second frequency band, wherein, for a predetermined number of bits to be allocated for the improvement coding or decoding, a first number of bits is allocated to a correcting coding or decoding for improving the core coding or decoding in the first frequency band and according to a first mode of coding or decoding and a second number of bits is allocated to the band extension coding or decoding for improving the band extension coding or decoding in the second frequency band and according to a second mode of coding or decoding.

* * * * *